US005725110A

United States Patent [19]

Kluge et al.

[11] Patent Number: 5,725,110

[45] Date of Patent: Mar. 10, 1998

[54] SPACE ORGANIZING SYSTEM

[75] Inventors: Richard G. Kluge, Lake Geneva, Wis.; John R. Sterling, Woodstock, Ill.

[73] Assignee: John Sterling Corporation, Richmond, Ill.

[21] Appl. No.: 787,641

[22] Filed: Jan. 23, 1997

[51] Int. Cl.[6] ..... A47F 7/00

[52] U.S. Cl. ..... 211/87.01; 211/192; 211/94.01; 108/108; 248/243

[58] Field of Search ..... 211/87.01, 187, 211/192, 123, 105.1, 204, 206, 208, 94.01, 189, 103; 248/225.11, 225.21, 247, 248; 108/108, 152

[56] References Cited

U.S. PATENT DOCUMENTS

| | | | |
|---|---|---|---|
| 3,051,318 | 8/1962 | Murphy | 211/94.01 |
| 3,313,424 | 4/1967 | Gingher | 211/94.01 X |
| 4,775,125 | 10/1988 | Pfeifer | 211/192 X |
| 4,971,281 | 11/1990 | Steinbeck | 211/192 X |
| 4,984,759 | 1/1991 | Perlant | 108/108 X |
| 5,110,080 | 5/1992 | Reiman . | |
| 5,185,971 | 2/1993 | Johnson, Jr. | 211/94.01 X |
| 5,257,766 | 11/1993 | Riblet | 248/248 |
| 5,313,891 | 5/1994 | Suttles | 108/108 X |
| 5,318,264 | 6/1994 | Meiste | 108/108 X |
| 5,433,327 | 7/1995 | Benvenuti et al. | 108/108 X |
| 5,538,213 | 7/1996 | Brown | 108/108 X |
| 5,582,303 | 12/1996 | Sloan . | |
| 5,584,404 | 12/1996 | Tsai | 211/94.01 |
| 5,620,160 | 4/1997 | Grabe | 248/243 X |

FOREIGN PATENT DOCUMENTS

| | | | |
|---|---|---|---|
| 2439143 | 2/1973 | Germany . | |
| 1110677 | 4/1968 | United Kingdom | 211/187 |

*Primary Examiner*—Peter M. Cuomo
*Assistant Examiner*—Robert J. Sandy
*Attorney, Agent, or Firm*—McCaleb, Lucas & Brugman

[57] ABSTRACT

A system for organizing the interior space of a closet into desired compartments involving horizontal shelves, clothes hanger rods and sliding drawers supported on a cantilever brackets removeably secured to selectively positioned vertical wall standards which are suspended from a single wall mounted horizontal hanger rail; the vertical wall standards having parallel rows of vertically aligned slot openings receptive of single or multiple rows of connector ears formed at connective end of the support brackets.

14 Claims, 4 Drawing Sheets

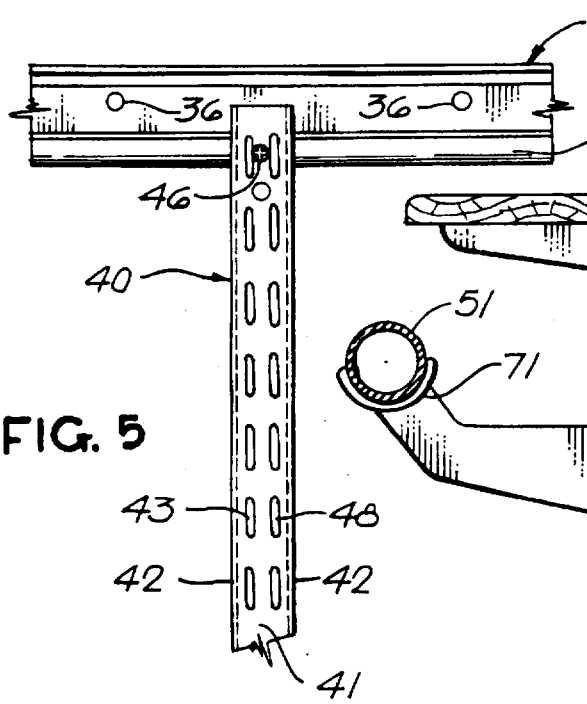
FIG. 5
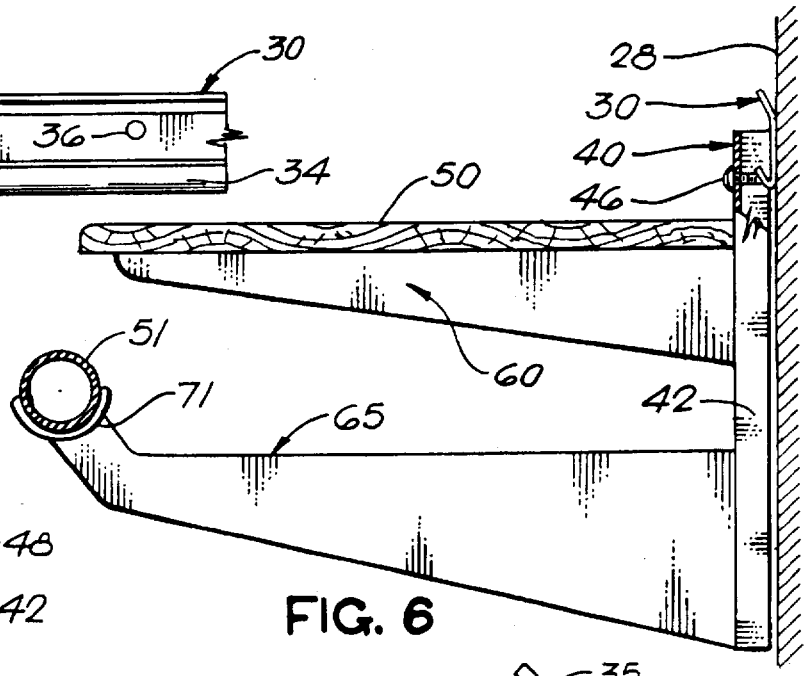
FIG. 6
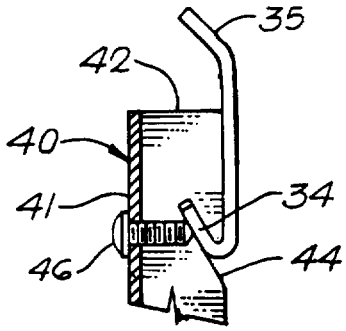
FIG. 7
FIG. 13
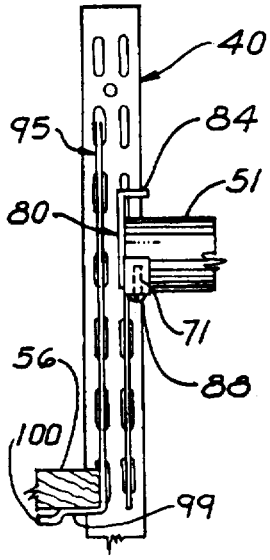
FIG. 12
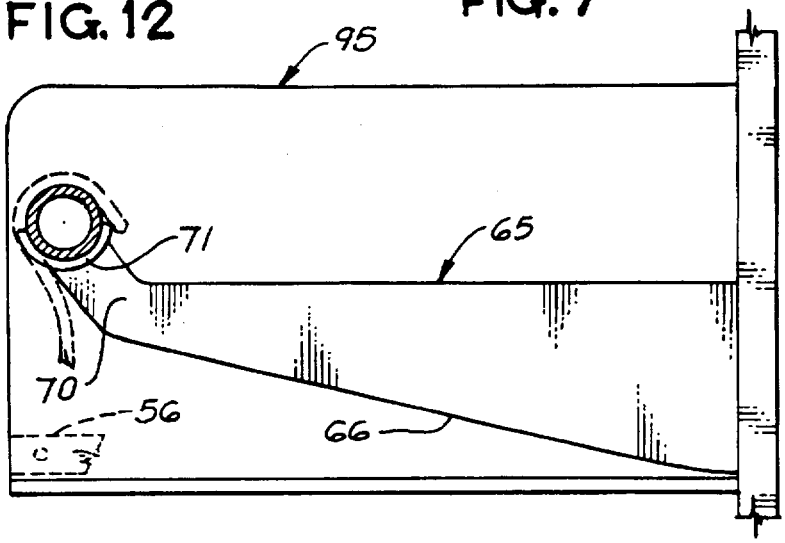

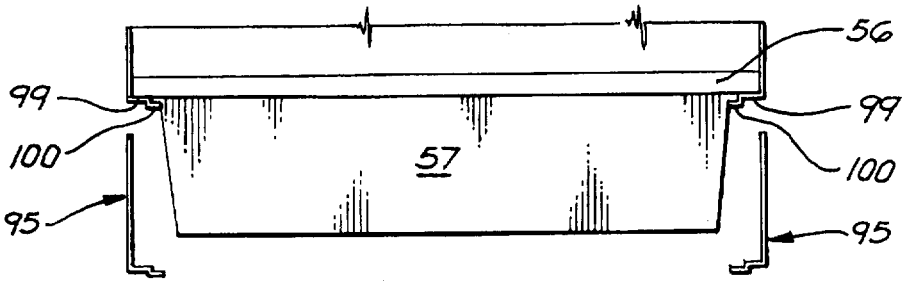
FIG. 19
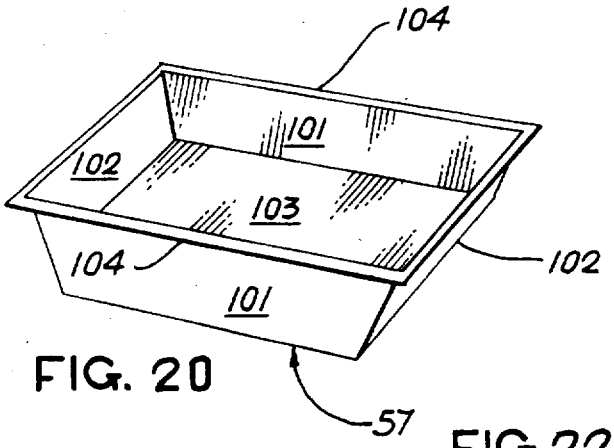
FIG. 20
FIG. 21
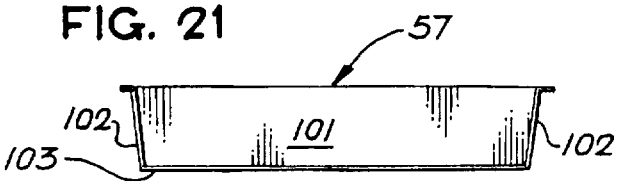
FIG. 22
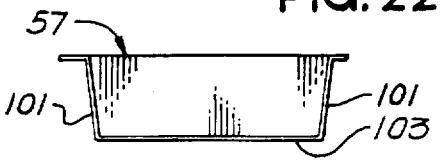

SPACE ORGANIZING SYSTEM

This invention is directed to systems for compartmentalizing the interior of clothes closets and like spaces and is particularly directed to improved hardware components used in such systems.

SUMMARY OF THE INVENTION

In brief this invention is directed to improvements in the combination of a rigid, elongated hanger rail adapted to be mounted horizontally along the upper margin of a vertical wall and characterized by an angularly, upwardly extending, lower marginal, mounting edge portion operationally oriented to extend at an acute angle away from the wall for hanging connection with one or more vertical metal wall standards of substantially U-shaped cross section having a front wall flanked by parallel sidewalls. The front wall of each standard is provided with parallel vertical rows of connector openings receptive of connector ears of associated support brackets. The wall standards are distinguished by angulated slots in the upper ends of the side walls thereof receptive by the angled mounting edge portion of the hanger rail, whereby to suspend the standards on the rail. When positioned on the hanger rail, each wall standard of this invention is equipped with locking means for anchoring the same to the hanger rail.

Novel cantilever shelf, drawer and clothes rod support brackets are provided to effect desired versatility in space arrangement and use. Uniquely, the support brackets are designed to utilize just one row of the two rows of slot openings in the wall standards. This permits mounting different type support brackets side-by-side on the same wall standard, thereby providing freedom to arrange clothes rods, shelves and drawers side-by-side, as desired.

It is a primary object of this invention to provide a new and improved system for organizing and utilizing the interior space of clothes closets and like spaces.

It is a further object of this invention to provide the improved system of the proceeding object in which novel cantilever support brackets are employed to support clothes hanger rods, shelving and drawers.

It is a still further object of this invention to provide an improved closet organizing system exhibiting simplified components productive of economy of manufacture and assembly.

Having described this invention, the above and further objects, features and advantages thereof will become apparent from the following detailed description of a preferred embodiment thereof illustrated in the accompanying drawings and representing the best mode presently contemplated for enabling those skilled in the art to practice this invention.

IN THE DRAWINGS

FIG. 5 is a partial enlarged front elevational view showing the hanger rail of FIG. 1 supporting a vertical wall standard;

FIG. 6 is a side elevational view of the hanger rail and wall standard of FIG. 5 with portions of the wall standard broken away in section and also illustrating a shelf bracket and clothes rod bracket mounted on the wall standard;

FIG. 7 is an enlarged side elevational view of the broken away portion of the wall standard seen in FIG. 6;

FIG. 12 is a partial side elevational view of the support bracket of FIGS. 10 and 11 and the clothes rod supporting bracket of FIGS. 8 and 9 assembled with a wall standard, clothes rod and shelf;

FIG. 13 is a partial front elevational view of the assembly shown in FIG. 12;

FIG. 19 is an enlarged front elevational view of the mounted drawer shown in FIG. 1;

FIG. 20 is a perspective view of the drawer shown in FIGS. 1 and 19;

FIG. 21 is a side elevational view of the drawer shown in FIG. 20; and

FIG. 22 is an end elevational view of the drawer of FIG. 20.

DESCRIPTION OF THE PREFERRED EMBODIMENT

Figure 1:
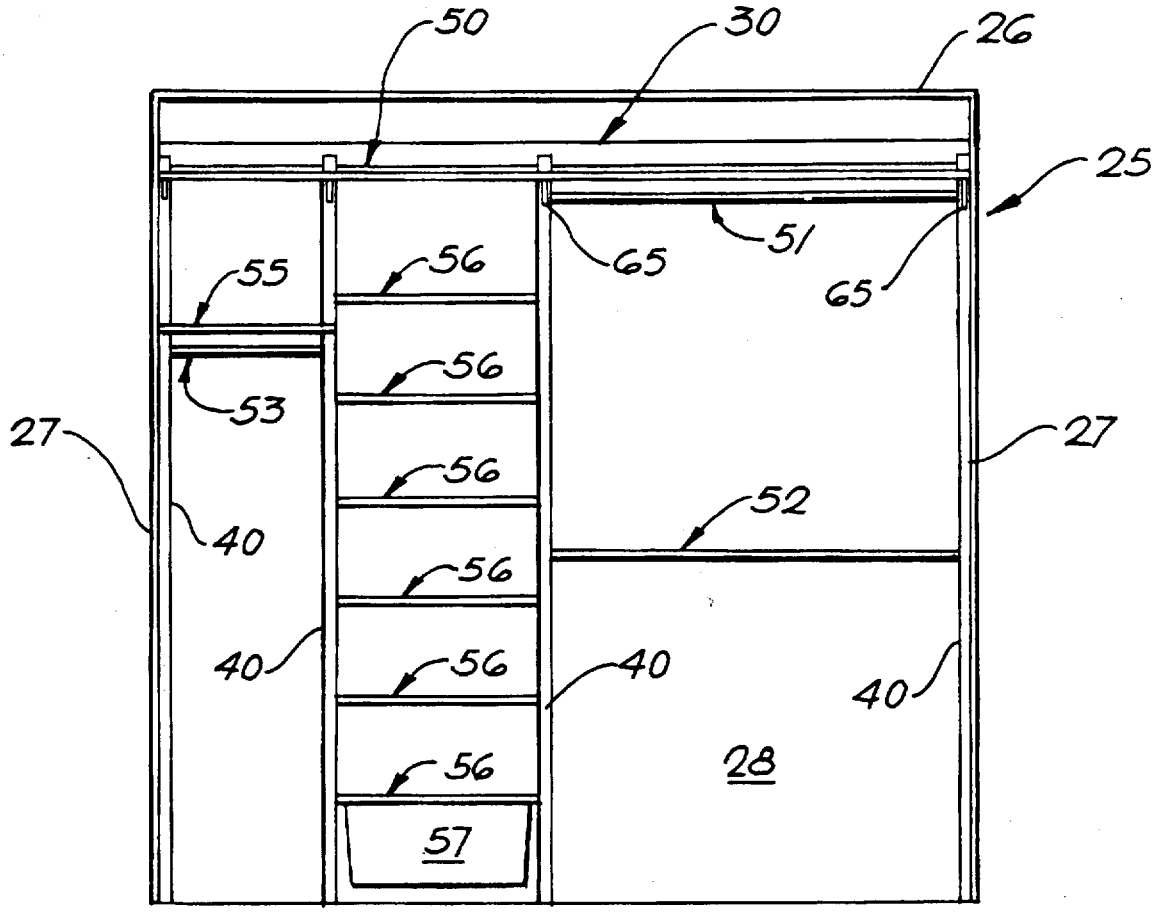
FIG. 1 is a schematic front elevational view of a typical closet space compartmentalized in accordance with the system of this invention.
Figure 2:
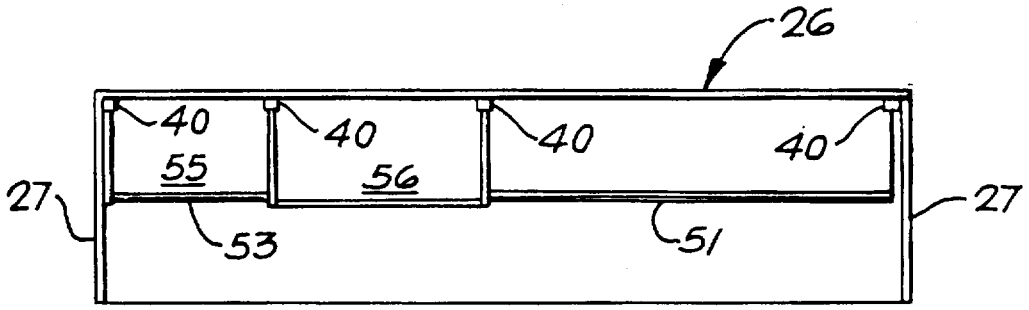
FIG. 2 is a top plan view of the closet space shown in FIG. 1, with a top shelf thereof removed.

As shown in FIGS. 1 and 2, the organizer system of this invention, indicated generally at 25, is fitted to the interior of a closet space defined by a ceiling wall 26, parallel vertical side walls 27, 27 and a back wall 28 extending between the ceiling and side walls according to conventional construction.

Organizer 25 comprises an elongated linear hanger rail 30 which may be cut to length and anchored to the back wall by conventional fasteners, such as screws and expansion plugs, to extend horizontally across the closet space adjacent ceiling 26.

Figure 3:
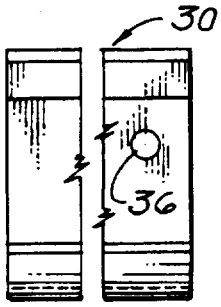
FIG. 3 is a foreshortened front elevational view of a hanger rail employed in the organizer system shown in FIGS. 1 and 2.
Figure 4:
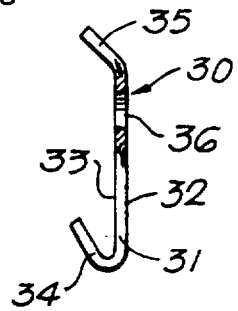
FIG. 4 is a right side elevational view of the rail shown in FIG. 3.
Figure 14:
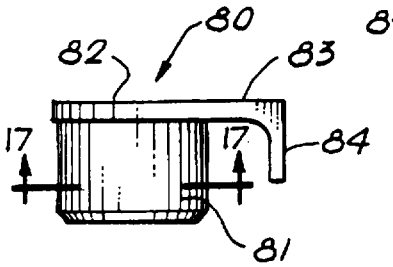
FIG. 14 is a top plan view of an end cap employed with the clothes hanging rod shown in FIG. 13.
Figure 15:
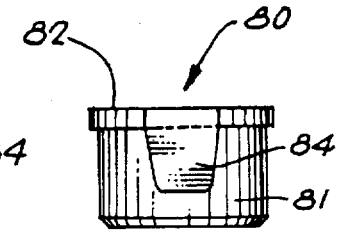
FIG. 15 is a right side elevational view of the cap shown in FIG. 14.
Figure 16:
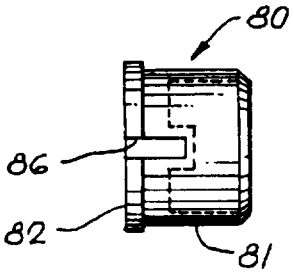
FIG. 16 is a left side elevational view of the cap shown in FIG. 14.
Figure 17:
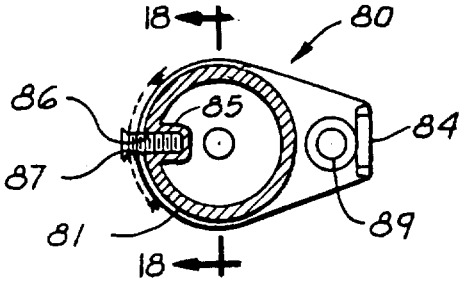
FIG. 17 is a cross sectional view taken substantially along vantage line 17—17 of FIG. 14, looking in the direction of the arrows thereon.
Figure 18:
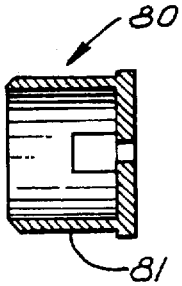
FIG. 18 is a cross sectional view taken substantially along vantage line 18—18 of FIG. 17 and looking in the direction of the arrows thereon.
Figure 9:
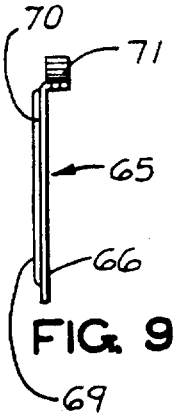
FIG. 9 is a front elevational view of the bracket shown in FIG. 8.
Figure 8:
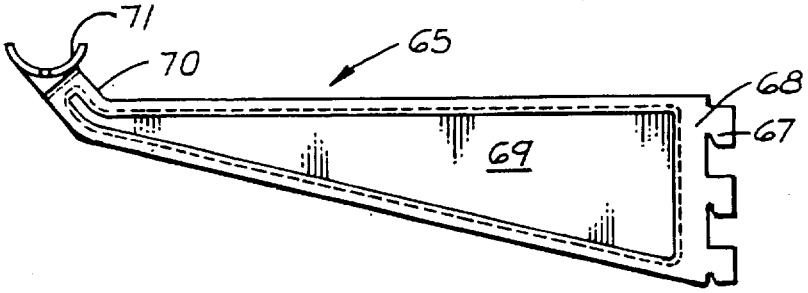
FIG. 8 is a side elevational view of a clothes rod bracket seen in FIG. 6.

As illustrated in FIGS. 3 and 4 the hanger rail has a planar body 31 having a back face 32 and a front face 33. Body 30 is bent upwardly at an acute angle along its lower margin to extend outwardly of face 33. This provides a marginal holding edge portion 34. A stop edge portion 35 is bent outwardly of front face 33 along the upper margin of the rail body and holes 36 extend through body 31 at laterally spaced intervals for passage of anchor screws whereby to fasten the rail 30 to back wall 28.

As seen best in FIGS. 1, 2 and 5–7; rail 30 supports a desired number of vertical standards 40, 40 (four in the illustrated case) at selected locations along the axis of rail 30. The standards are of known structure composed of an elongated metal bar of general U-shaped cross section defining a wide front wall 41 flanked by parallel side walls 42, 42 (see FIG. 5). Wall 41 is provided with two parallel rows of axially spaced slots 43 which are vertically positioned in operation. In order to suspend the standard from the hanger rail 30, side walls 42, 42 of each of the standards are provided with downwardly inclined registeringly aligned slots 44 adjacent their upper ends. Slots 44 fit over the angularly projecting holding edge 34 of the rail 30 (see FIG. 7). As so far described, the standards and hanger rail, aforenoted, are conventional, known structures. However, one of the problems faced with such past known hanger rail and vertical standards, is that of preventing lateral movement of the standards once they are mounted on the rail edge. While the stop edge portion 35 of the rail 30 deters vertical upward movement and accidental detachment of a standard 40 from the hanger rail, there is no means to positively prevent lateral displacement of the mounted standards except for vertical loads carried thereby in the prior known rail and standard mountings.

Accordingly, it will be noted from FIGS. 5–7, that this defect in the prior art has been addressed herein by providing a self-tapping metal locking screw 46 which extends through the front wall 41 of a standard opposite the upper ends of the slots 44 in side walls 42. With this arrangement once a standard 40 is suspended from the hanger rail, as above related, threaded advance of the locking screw causes its outer end to engage the rail holding edge portion 34. This serves to lock the standard at a desired position along rail 30 and prevents its accidental detachment from the rail. If desired, once a standard is locked in position, attachment screws and anchor plugs may be used to anchor the standard in place in a known manner. However, in most instances, the organizer assembly is designed to fill the closet space between the side walls 27, so that the vertical standards are thereby held in their desired positions with no need to anchor them to back wall 28, other than by means of the hanger rail and lock screw, as described.

FIGS. 1 and 2 depict the system 25 hereof installed in an example closet as including a full width unitary shelf 50 located at the upper end of the closet space at approximately 84" above the floor. At the right hand side of the closet are two clothes rods, 51 and 52; one about 80' above the floor and the other at about 40' to afford double deck hanging of short articles of clothing, such as shorts, blouses, pants on fold over hangers, etc. On the left side of the closet is a single short rod 53 about 20' long located about 60' above the floor for hanging longer clothing, such as dresses, etc. A shelf 55 is mounted directly above rod 53 for additional storage.

In the left central area of the closet is a stack of approximately 24' shelves 56, 56 for storing sweaters, shoes, etc. with a storage drawer 57 suspended beneath the bottom shelf 56. Additional drawers may be suspended from other shelves 56, as directed.

All components of the system are mounted on the wall standards by cantilever brackets, as will appear in greater detail presently.

As shown in FIG. 6, top shelf 50 is supported on four conventional metal shelf brackets 60, 60 of known structure having ears at their inner ends for connectively engaging appropriate slots in the wall standard 40. If desired, shelf 50 may be secured to brackets 60 by appropriate screws in a known manner.

The three clothes rods 51, 52, and 53 are supported by cantilever rod support brackets 65, shown in FIGS. 6, 8, 9 and 12. As will best be understood from FIGS. 8 and 9, bracket 65 of this invention comprises a flat metal plate body 66 of general right angle triangle profile having a series of downwardly directed connector ears 67 extending from its base leg portion 68 and a laterally offset triangular central platform 69 stamped in body 66 for improved structural strength. The outer apexual end of the triangular body opposite base leg 68 thereof is turned upwardly at a 45° angle to provide an extended neck portion 70 supporting a semi-circular cradle 71 at its outer end for receiving a tubular clothes rod therein. It will be noted that cradle 71 projects at right angles to the plane of body 66 and extends outwardly of only one side thereof.

It is to be noted that the outer ends of the clothes rods are fitted with molded metal or plastic caps 80, illustrated in FIGS. 14–18. Each cap has a cylindrical body 81 having an outside diameter snugly receptive within an open end of a clothes rod. The axially outer end of body 81 is closed by an end wall 82 that is integral with an arm portion 83 extending radially outward of one side of body 81 and which has a finger 84 extending at right angles to the plane of arm 83 to partially overhang body 81 (see FIGS. 14 and 15).

In substantial opposite alignment with finger 84 is boss 85 formed to extend radially inwardly into the hollow interior of the cap body 81. Boss 85 has an internal cylindrical chamber 86 open at its outer end 87. In assembly, body 81 is inserted into the open end of the tubular clothes rod so that the open end 87 of boss 85 aligns with an opening (not shown) formed through a wall of the clothes rod. A screw fastener 88 passes through the opening in the clothes rod and threadingly engages the walls of chamber 86 to interconnect the rod and cap (see FIG. 13). Arm 83 of the cap is provided with an opening 89 adjacent finger 84 for passage of a screw fastener for the purpose of fastening the end cap to an adjacent wall of the closet or to a separator bracket 95 (see FIG. 13).

It is to be understood that if a longer clothes rod is employed requiring additional support intermediate its ends, a centrally mounted third bracket 65 meets that requirement.

Additionally, it will be seen from FIG. 12 that the extending necks 70 of the several rod brackets permit free passage of hook portions of clothes hangers along the length of the clothes rod as indicated by the dotted line clothes hook in FIG. 12. This is particularly apparent where a rod support is required intermediate the ends of the clothes rod. Due to this feature it also is important to provide means for preventing the clothes hangers from sliding off the ends of the clothes rod. The end caps 80 function to meet this problem inasmuch as the extending arm portions 83 and overhanging fingers 84 thereof serve to engage the hanger hook to stop the hangers from moving past the ends of the clothes rods.

Figure 11:
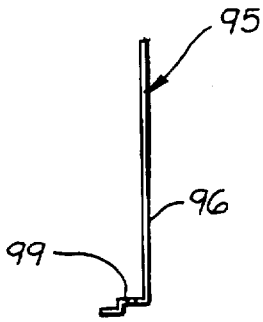
FIG. 11 is a front elevational view of the bracket shown in FIG. 10.
Figure 10:
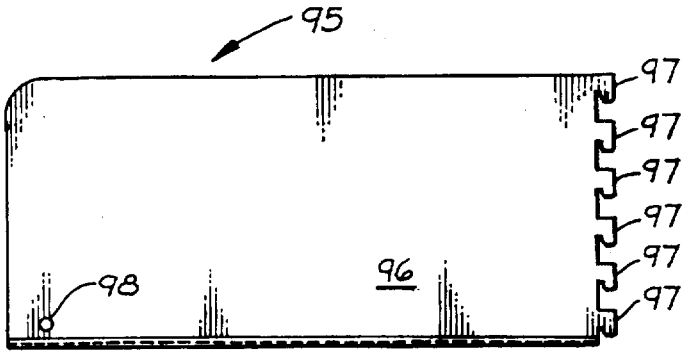
FIG. 10 is a side elevational view of a shelf and drawer support bracket.

In FIGS. 10, 11 and 13 the features of a combined shelf and drawer support bracket 95 are illustrated. As therein shown, a planar generally rectangular metal body 96 of bracket 95 is formed with a single row of connector ears 97 at one base end for interconnection with a single row of the slotted opening 43 in a vertical standard 40. Body 96 is provided with one or more circular openings 98 adjacent its lower edge for reasons which will appear hereinafter. Uniquely, the bottom margin of body 96 is bent at right angles to the body's formational plane to form a planar shelf supporting flange 99 and a lower positioned parallel offset flange 100 forming a sliding drawer support.

It will be noticed from FIG. 13, that due to the narrow thickness of both the rod support brackets 65 and the shelf and drawer support brackets 95, such two type brackets may be mounted side-by-side; each engaged with a single row of slots 43 of the same vertical standard 40. Additionally, since a pair of brackets 95 are required to slidingly support a drawer 57, it is necessary to provide both right and left hand brackets 95. FIGS. 10–13 illustrate a right handed bracket; a left handed bracket differing only in the direction that the flanges 99 and 100 are bent from body 96.

From FIG. 1 it will be recognized that the short shelves 56 are mounted and supported between pairs of right hand and left hand brackets 95. In that regard once the shelves are in place suitable screw fasteners pass through the bracket openings 98 to secure the shelves 56 in place and rigidify the assembly. It also will be recognized that the rectangular body of each shelf bracket 95 provide a barrier to prevent clothes or other articles from falling off of the ends of shelves 56.

At the bottom of the stack of shelves 56 in the illustrated embodiment, is a drawer unit 57 shown in FIGS. 19–22; although additional drawers may be mounted between any two shelves 56 since each set of brackets 95 will support a drawer.

As will be best recognized from FIGS. 20–22, drawers 57 are substantially rectangular, open top vessels with longer side walls 101, shorter end walls 102, and a planar bottom wall 103. Lip flanges 104 extend outwardly of the upper edges of the several walls 101 and 102, with the longer flanges 104 extending outwardly of the upper edges of side walls 101, serving to overengage the offset flanges 100 of the shelf support brackets 95 in the manner illustrated in FIGS. 1 and 19. This provides an appropriate sliding connection and support of the drawers beneath over disposed brackets 95.

From the foregoing, it is believe that those skilled in the art will readily appreciate the novel advancement of this invention over the prior art and while the same has been disclosed in relation to a preferred embodiment thereof illustrated in the accompanying drawings it is to be recognized that the same is readily susceptible to modification, variation and substitution of equivalents without avoiding the invention which is intended to be unlimited by the foregoing except as may appear in the following appended claims.

The embodiments of the invention in which an exclusive property or privilege is claimed are defined as follows:

1. A system for organizing the interior space of a closet into compartments involving horizontal shelves, clothes rods and drawers supported on a vertical closet wall, comprising in combination:

an elongated, rigid hanger rail mounted horizontally across the upper margin of the vertical closet wall, characterized by an angularly upwardly extending mounting edge formed along one margin of the rail's planar body and oriented to extend outwardly of said closet wall in operation;

a plurality of vertically, elongated standards of substantially U-shaped cross section each formed by parallel side walls integral with a cross connecting front wall;

said side walls having registeringly aligned slotted openings formed adjacent one end thereof and oriented for receiving said mounting edge therein whereby to suspend said standards vertically from said hanger rail; and a locking screw moveable through the front wall of each vertically suspended standard for engaging said mounting edge whereby to lock each standard to said hanger rail.

2. The system of claim 1, wherein each of said elongated standards has two parallel rows of axially aligned, slots in the front wall thereof.

3. The system of claim 2, and cantilever shelf support brackets each formed with a substantially elongated rectangular planar body, a single row of connector ears extending from one end of said rectangular body for inserted connection with a single row of said slots, and a planar shelf support flange extending outwardly at right angles to the formational plane of said rectangular body along a lower marginal edge thereof for undersupporting one end of a horizontal shelf thereon.

4. The system of claim 3, and a second planar drawer supporting flange formed in integral offset parallel relation with said shelf supporting flange.

5. The system of claim 4, wherein a pair of said shelf support brackets mounted on laterally spaced standards serve to slidingly support a drawer therebetween; said drawer being formed with outwardly extending flanges along the upper edges of opposing side walls thereof for slidably engaging the upper sides of said drawer supporting flanges.

6. The system of claim 2, and plural cantilever clothes rod support brackets each having a substantially triangular profiled body formed with a single row of downwardly directed connector ears at one base end thereof for connective engagement with a single row of said slots in a vertical standard, a neck portion extending angularly upwardly from an apexual outer end of said triangular body, and a semi-cylindrical cradle mounted transversely across the outer end of said neck portion for undersupporting a cylindrical clothes rod thereon.

7. The System of claim 6, wherein each of said rod support brackets has a central offset platform section integral with its said triangular body for rigidifying each bracket.

8. The system of claim 6, wherein a pair of said rod support brackets are located adjacent opposite ends of a clothes rod, and end caps fitted onto outer ends of said clothes rod include radially extending árms positioned to prevent passage of clothes hangers past said end caps.

9. The system of claim 1, wherein said hanger rail and standards are of rigid metallic material.

10. The system of claim 9, and said planar body having at least one opening for the passage of a fastener for connecting said body with the end of a shelf supported on said flange.

11. A system for organizing the interior space of a closet into separated compartments incorporating horizontal shelves and drawers supported on a vertical closet wall, the system comprising in combination:

a plurality of rigid, elongated standards of substantially U-shaped cross section defined by parallel side walls integral with a cross connecting front wall mounted in vertical, parallel spaced relation on the vertical closet wall;

each of said standards having at least one row of axially aligned slots along the length of said front wall thereof;

cooperating pairs of cantilever shelf support brackets mounted on adjacent said standards, each of said brackets having an elongated planar body with connector ears extending outwardly from one end thereof for inserted connection with selected of said slots whereby to secure said brackets to said standards;

each shelf support bracket having a planar shelf flange extending laterally outwardly along a lower marginal edge of its said body for supporting an end of a shelf thereon.

12. The system of claim 11, wherein each cooperating pair of said shelf brackets has shelf flanges thereof extending from opposite sides of respectively related bracket bodies whereby to form cooperating left and right handed brackets for supporting a planar shelf therebetween.

13. The system of claim 11, wherein each of said shelf brackets has a second lengthwise extending planar flange in offset parallelism below the level of said shelf flange thereof for slidably engaging a cooperating lip flange extending laterally outwardly from one side of a drawer.

14. The system of claim 11, and an elongated hanger rail mounted horizontally on said vertical wall, and means for connectively suspending said standards vertically from said hanger rail.

* * * * *

UNITED STATES PATENT AND TRADEMARK OFFICE

CERTIFICATE OF CORRECTION

PATENT NO. : 5,725,110

DATED : March 10, 1998

INVENTOR(S) : Richard G. Kluge and John R. Sterling

It is certified that error appears in the above-identified patent and that said Letters Patent is hereby corrected as shown below:

Col. 3, line 47, delete "80' ", and insert -- 80" --;

Col. 3, line 48, delete "40' " and insert -- 40" --;

Col. 3, line 51, delete "20' " and insert -- 20" --;

Col. 3, line 51, delete "60' " and insert -- 60" --;

Col. 3, line 56, delete "24' " and insert -- 24" --;

Col. 6, line 6, delete "planar"; and

Col. 6, line 33, delete "System" and insert -- system --.

Signed and Sealed this

Twenty-third Day of June, 1998

Bruce Lehman

*Attest:*

BRUCE LEHMAN

*Attesting Officer*

*Commissioner of Patents and Trademarks*